US009533337B2

(12) United States Patent
Flehmig

(10) Patent No.: US 9,533,337 B2
(45) Date of Patent: Jan. 3, 2017

(54) APPARATUS AND METHOD FOR PRODUCING AT LEAST PARTIALLY CLOSED HOLLOW PROFILES WITH A SHORT CYCLE TIME

(71) Applicant: Thomas Flehmig, Ratingen (DE)

(72) Inventor: Thomas Flehmig, Ratingen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 969 days.

(21) Appl. No.: 13/793,976

(22) Filed: Mar. 11, 2013

(65) Prior Publication Data

US 2013/0186164 A1 Jul. 25, 2013

Related U.S. Application Data

(63) Continuation of application No. PCT/EP2011/065725, filed on Sep. 12, 2011.

(30) Foreign Application Priority Data

Sep. 14, 2010 (DE) ..... 10 2010 037 533

(51) Int. Cl.
*B21D 22/00* (2006.01)
*B21C 37/08* (2006.01)
*B21D 5/01* (2006.01)

(52) U.S. Cl.
CPC ..... *B21D 22/00* (2013.01); *B21C 37/0815* (2013.01); *B21D 5/015* (2013.01)

(58) Field of Classification Search
CPC ..... B30B 7/02; B30B 7/023; B30B 11/08; B30B 11/10; B30B 15/02; B30B 15/062; B30B 15/065; B30B 9/042; B30B 9/045; B21D 5/015; B21D 5/02; B21D 5/025; B21D 51/00; B21D 22/00; B21D 22/02

(Continued)

(56) References Cited

U.S. PATENT DOCUMENTS 1,330,782 A * 2/1920 Brown ..... B21D 5/015 59/27
1,387,199 A * 8/1921 Small ..... B21C 37/0815 138/171

(Continued)

FOREIGN PATENT DOCUMENTS

CN 1148822 A 4/1997
DE 667949 C 11/1938

(Continued)

*Primary Examiner* — Moshe Wilensky
*Assistant Examiner* — Pradeep C Battula
(74) *Attorney, Agent, or Firm* — Reinhart Boerner Van Deuren P.C.

(57) ABSTRACT

The invention relates to a device and a method for producing at least partially closed hollow profiles from a sheet by a U-O-forming with a tool set having a U-punch in a first tool half for producing an at least partially U-shaped sheet and an upper die in a second tool half for forming an at least partially U-shaped sheet into an at least partially closed hollow profile. Parts of the tool set run parallel to one another in the axial direction of the at least partially closed hollow profile to be produced and are arranged above one another in the closing direction of the tool halves, wherein a common matrix receiver is provided between the tool halves of the tool set, which receiver comprises at least two identical, partially U-shaped dies for the tool set and can rotate about its axial axis.

12 Claims, 4 Drawing Sheets

(58) Field of Classification Search
USPC ..... 72/389.1, 368, 472, 367.1
See application file for complete search history.

(56) References Cited

U.S. PATENT DOCUMENTS

| | | | | |
|---|---|---|---|---|
| 1,879,077 | A | 9/1932 | Carlsen | |
| 1,879,078 | A | 9/1932 | Carlsen | |
| 2,077,336 | A | 4/1937 | Lemming | |
| 3,094,758 | A * | 6/1963 | Boyd | B30B 15/024 425/352 |
| 3,271,834 | A * | 9/1966 | Mazzoni | B30B 11/10 425/302.1 |
| 3,693,398 | A * | 9/1972 | Pedersen | B21D 51/10 72/368 |
| 4,144,736 | A * | 3/1979 | Honda | B21D 28/12 72/404 |
| 4,339,941 | A | 7/1982 | Taira et al. | |
| 4,466,267 | A | 8/1984 | Casler et al. | |
| 6,170,309 | B1 * | 1/2001 | Marando | B21D 26/039 29/421.1 |
| 6,386,009 | B1 * | 5/2002 | Ni | B21D 37/12 29/421.1 |
| 6,986,273 | B2 * | 1/2006 | Rager | B21D 26/039 29/421.1 |
| 7,350,386 | B2 * | 4/2008 | Streubel | B21C 37/0815 219/61 |
| 8,276,428 | B2 * | 10/2012 | Bruggenbrock | B21D 5/015 72/389.1 |
| 8,459,076 | B2 * | 6/2013 | Flehmig | B21D 5/015 72/380 |
| 2006/0208036 | A1 * | 9/2006 | Hauger | B21C 37/065 228/173.4 |
| 2013/0186165 | A1 * | 7/2013 | Flehmig | B21D 5/015 72/343 |
| 2013/0276505 | A1 * | 10/2013 | Kitai | B21D 22/08 72/360 |
| 2015/0129556 | A1 * | 5/2015 | Grosseruschkamp | B21D 5/015 219/61 |

FOREIGN PATENT DOCUMENTS

| | | | |
|---|---|---|---|
| DE | 8536655 | U1 | 4/1986 |
| DE | 102004046687 | B3 | 6/2006 |
| DE | 102007021798 | A1 | 11/2008 |
| DE | 102007033820 | B4 | 5/2010 |
| DE | 102007021798 | B4 | 3/2011 |
| EP | 1690607 | A1 | 8/2006 |
| JP | 59-232620 | A | 12/1984 |

* cited by examiner

APPARATUS AND METHOD FOR PRODUCING AT LEAST PARTIALLY CLOSED HOLLOW PROFILES WITH A SHORT CYCLE TIME

CROSS-REFERENCE TO RELATED PATENT APPLICATIONS

This patent application is a continuation of PCT/EP2011/065725, filed Sep. 12, 2011, which claims priority to German Application No. 102010037533.0, filed Sep. 14, 2010, the entire teachings and disclosure of which are incorporated herein by reference thereto.

FIELD OF THE INVENTION

The invention relates to a device for producing at least partially closed hollow profiles from a sheet or plate by a U-O forming with a tool set comprising a U-punch in a first tool half for producing an at least partially U-shaped sheet and an upper die in a second tool half for forming an at least partially U-shaped sheet into an at least partially closed hollow profile. In addition, the invention relates to a method for producing an at least partially closed hollow profile from a sheet.

BACKGROUND OF THE INVENTION

At least partially closed hollow profiles are frequently used in automobile construction to replace open profiles and profiles welded to one another. The number of forming steps resulting from the complex forming procedure conflicts, however, with an economic production. U-O-forming used in mass production requires at least two shaping steps, wherein each shaping step is performed separately in one or more presses and the component is re-straightened between the work stations. Although with a favourable design and arrangement one finished part can thus be produced per press stroke, nevertheless, this device requires comprehensive tool sets as well as several robots or feeders for transporting the sheets and the semi-finished sheets between the individual tools. In particular there is the problem that with the U-O-forming the initially at least partially U-shaped formed sheet is removed form the die and is introduced into the die for the U-forming. This leads to technical problems, especially in relation to a skew alignment during the insertion into the O-die. In addition, problems can occur with highly resilient materials, in that these cannot be introduced directly into the die for the O-forming. From German patent application DE 10 2007 021 798 A1 belonging to the Applicant, a device is known for producing at least partially closed profiles, which comprises a displaceable base plate and a displaceable punch, so that the initially U-shaped formed sheet can remain in the corresponding matrix before the O-forming. The cycle time that can be achieved with this device needs to be improved, however, since only one finished part can be produced with each second press stroke. In addition, the cost and complexity of the apparatus involved with this device is relatively high.

SUMMARY OF THE INVENTION

Against the above background one object of the present invention is accordingly to propose a device and a method for producing at least partially closed hollow profiles from a sheet, which ensures the production of corresponding profiles with a short cycle time and high process reliability.

According to a first teaching of the present invention this object is achieved by a device characterised in that the parts of the tool set run parallel to one another in the axial direction of the at least partially closed hollow profile to be produced and are arranged above one another in the closing direction of the tool halves, wherein a common matrix receiver is provided between the tool halves of the tool set, which comprises at least two identical, partially U-shaped dies for the tool set and the matrix receiver can rotate above its axial axis.

First of all the arrangement of the parts of the tool set running above and parallel to one another means that with a single closing procedure the tool set can be closed and thus a forming of a sheet or of a preformed sheet can take place simultaneously in both tool halves. The matrix receiver rotatable about its axial axis means that the sheet does not have to be removed from the at least partially U-shaped die used for the U-forming, but by rotation can be positioned in the second tool half, in order then to be formed into an at least partially closed hollow profile. Owing to the rotation of the matrix receiver about its axial axis the positioning of the at least partially U-shaped sheet in the next tool half for the O-forming and for the production of an at least partially closed hollow profile can take place. The rotatable matrix receiver does not require any complicated apparatus for this purpose. Furthermore, handling systems and robots and feeders are required simply for the insertion of the sheet and the removal of the finally produced at least partially closed hollow profile.

According to a first configuration of the device the matrix receiver comprises more than two at least partially U-shaped dies, wherein the number of dies being a multiple of two. The matrix receiver can therefore preferably contain four, six or, for example, eight U-shaped dies, so that the matrix receiver can simultaneously receive a plurality of sheets to be formed. In particular the removal of the finally produced, at least partially closed profiles can then take placer without any problem or delay in the cycle time during or between the closing movements of the tool halves.

In order to maximise the process reliability and minimise the wear of the device, according to a further modification of the device the matrix receiver is movable and optionally relieved of weight in the closing direction of the tool halves. The displaceability allows the forming device to be simplified, since one of the tool halves of the device can be formed stationary. Thanks to the optional weight relief the wear of the rotatable matrix receiver is reduced for example in the necessary bearings of the pillow blocks.

In order to permit particularly complex shaping operations, the use of a support core in the O-forming is often necessary. The device can therefore advantageously be modified by providing pillow blocks for the rotatable bearing of the matrix receiver and also at least one core puller system, wherein the at least one core puller system is optionally arranged on the pillow blocks. The arrangement of the core puller system on the pillow blocks of the matrix receiver allows a simple positioning of the core puller system in the region of the O-forming to be correspondingly performed, in order to position the support core before the forming or to remove it from the at least partially closed hollow profile after the forming.

However, an arrangement of the core puller system in the second tool half is also feasible.

According to a next modification of the device according to the invention, the U-punch is arranged underneath the upper die, wherein hold-down devices are optionally associated with the U-punch. The arrangement of the U punch underneath the upper die allows a simple insertion of a sheet for the implementation of the U-forming. The optionally provided hold-down devices in the first tool half allow a controlled feed of the sheet in the U-forming and ensure, especially if as these can move as far as the apex baseline of the U-punch of the first tool half, a further improved insertion of the sheet.

Preferably, the at least partially U-shaped dies of the matrix receiver comprise sidewalls, whose height is at least half of the maximum rolled-out sidewall length of the hollow profile to be produced. The maximum rolled-out sidewall length of the hollow profile to be produced corresponds to the maximum length of a U-arm of the at least partially U-shaped formed sheet. The corresponding modification of the sidewalls of the at least partially U-shaped dies of the matrix receiver allows a U-forming, which especially in the case of highly resilient materials offers a higher process reliability in the subsequent O-forming, since the arms of the at least partially U-shaped sheet can in this case can no longer greatly expand due to restoring forces.

If the sidewalls of the at least partially U-shaped dies comprise partial regions with a rounded inlet that are outwardly displaceable, in a further modification of the device the threading process in the O-forming in the second tool half, in which the arms of the at least partially U-shaped formed sheet have to be guided into the upper die of the second tool half, is simplified and the process is more secure.

Furthermore, means for implementing further work stages on the at least partially U-shaped sheet or on the at least partially closed hollow profile can be provided, so that further work stages can be carried out on the at least partially U-shaped sheet in the matrix receiver before the sheet is formed into the at least partially closed hollow profile. It is also feasible for the work stages to be carried out after the forming of the at least partially U-shaped sheet into an at least partially closed hollow profile.

According to a second teaching of the present invention the object described above is achieved by a method for producing an at least partially closed hollow profile from a sheet using the device according to the invention, comprising the following steps:

Inserting a flat sheet into the first tool half,

Forming the sheet in the first tool half by closing the tool halves of the tool set, to form an at least partially U-shaped sheet, Opening the tool halves and rotating the matrix receiver, so that an at least partially U-shaped sheet is positioned in the second tool half and a further U-shaped die is positioned in the first tool half, Inserting a second sheet into the first tool half, and Closing the tool halves and simultaneously forming the partially U-shaped sheet into an at least partially closed hollow profile in the second tool half and forming the inserted sheet into a partially U-shaped sheet in the first tool half.

Before the forming of the at least U-shaped sheet in the second tool half, a support core can optionally be positioned by means of a core puller system in the at least partially U-shaped formed sheet, which core puller system is removed again before removing the finished hollow profile.

As will become clear from the description of the method according to the invention, simply by means of a closing procedure of the tool halves a U-forming and also an O-forming are simultaneously carried out in the device. As a result, an at least partially closed hollow profile is formed complete with each closing procedure. The cycle times of the method according to the invention are correspondingly short. In addition, the complexity of the apparatus for carrying out the invention is low, since robots or feeders are required simply for the insertion of a flat sheet and the removal of the finished produced hollow profiles.

The method according to the invention can be further improved if the matrix receiver comprises four at least partially U-shaped dies and the matrix receiver is rotated in each case by 90° after each opening of the first and second tool halves. In this way the cycle times for rotating the matrix receiver and for positioning an at least partially U-shaped formed sheet in the second tool half are reduced. In addition, a simple removal of the finished formed parts after the O-forming and the rotation of the matrix receiver by 90° is also made possible.

In order to improve the process reliability in the O-forming the at least partially U-shaped dies of the matrix receiver comprise laterally displaceable partial regions of the sidewalls with rounded inlets, which on closing the tool halves of the tool set are optionally displaced outwardly through the sidewalls of the upper die of the second tool half. As a result of this procedure, the threading of the U-arms of the at least partially U-shaped sheet into the corresponding upper die of the second tool half can easily be simplified and made more process reliable. If the sidewalls of the upper die of the second tool half displace the displaceable partial regions of the sidewalls of the U-shaped dies of the matrix receiver outwardly, then for example means for the active displacement of the displaceable partial regions of the sidewalls can be dispensed with, so that the device can be simplified further. The displaceable partial regions may for example be spring-activated, so that these return to their original position after the opening of the second tool half. These movements of the partial regions may, however, also be carried cumulatively or alternatively actively.

Finally, the method is improved further if further work stages are carried out on the at least partially U-shaped sheet or on the at least partially closed hollow profile in the matrix receiver.

BRIEF DESCRIPTION OF THE DRAWINGS

The invention is now described in more detail hereinafter by the description of an exemplary embodiment and with the aid of the drawings, in which.

DETAILED DESCRIPTION OF THE INVENTION

Figure 1:
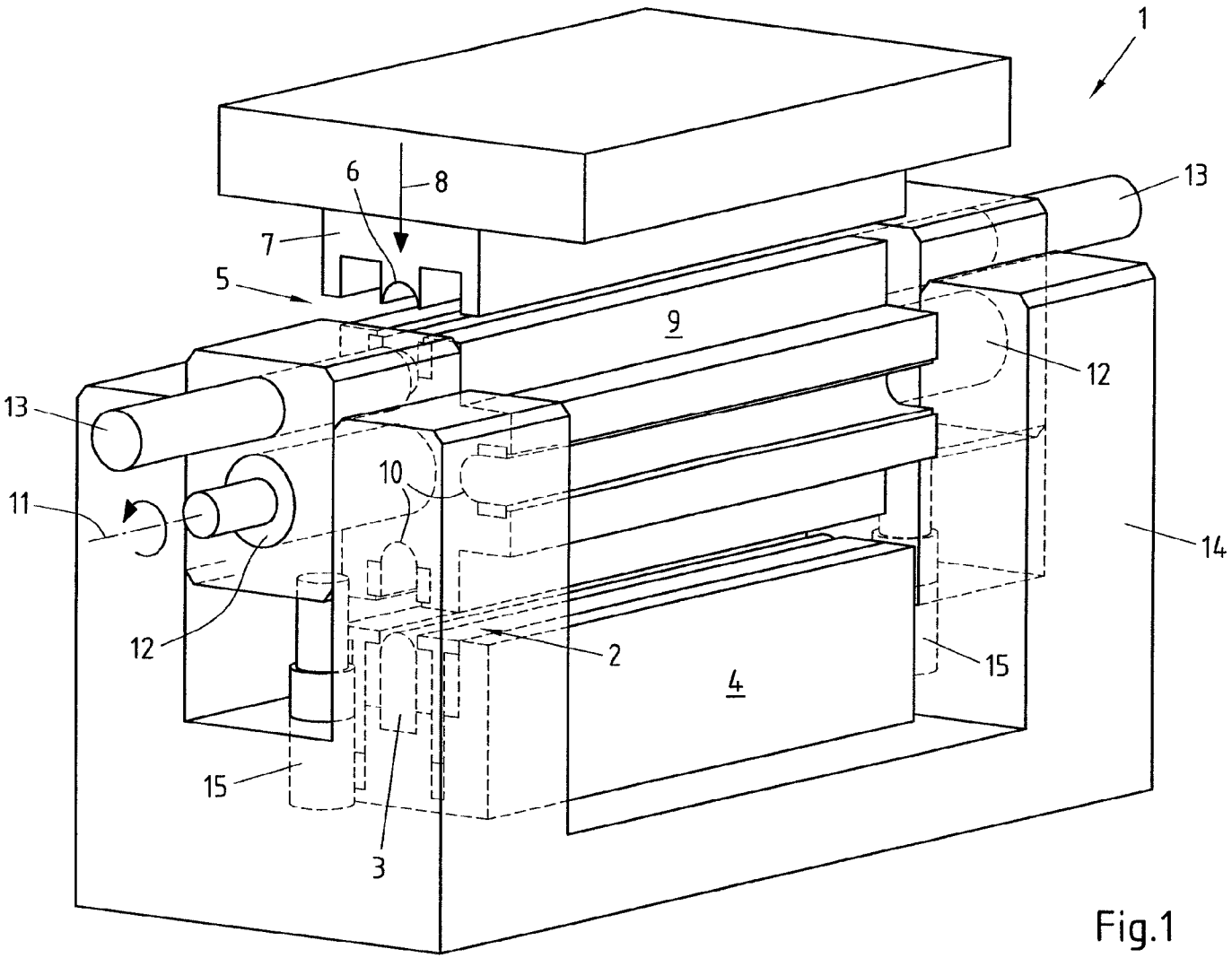
FIG. 1 is a schematic, perspective view of an embodiment of the invention.

FIG. 1 shows first of all an embodiment of the device for producing at least partially closed hollow profiles from a sheet in the open state. The device 1 comprises a tool set 2, 5 which includes a U-punch 3 that is arranged in the first tool half 4. An upper die 6 is furthermore included, which is arranged for the forming of an at least partially U-shaped sheet into an at least partially closed profile in the second tool half 7. It can also be seen that the parts of the tool set 2, 5 run parallel to one another and in the closing direction 8 the tool halves 4, 7 are arranged above one another. The matrix receiver 9 comprises in the embodiment illustrated here four identical, at least partially U-shaped dies 10, which are arranged radially around the axial axis 11 of the matrix receiver 9. The matrix receiver 9 is rotatably mounted about its axial axis 11. The matrix receiver can be rotated by means of a positioning drive 12, which is shown here simply schematically.

At the same time FIG. 1 also shows a core puller system 13, which is arranged in the region of the second tool half and permits the introduction of a support core into the at least partially U-shaped sheet to be formed, and its removal after the forming process. The support core used by the core puller system is not illustrated in the present case.

The core puller system 13 is arranged on pillow blocks 14, which are likewise only shown schematically here. In addition, means 15 are provided for the weight relief, for example in the form of gas-actuated compression springs, which hold the matrix receiver 9 at a middle height level and allow a displacement of the matrix receiver 9 in the closing direction of the tool set 2, 5.

Figure 2:
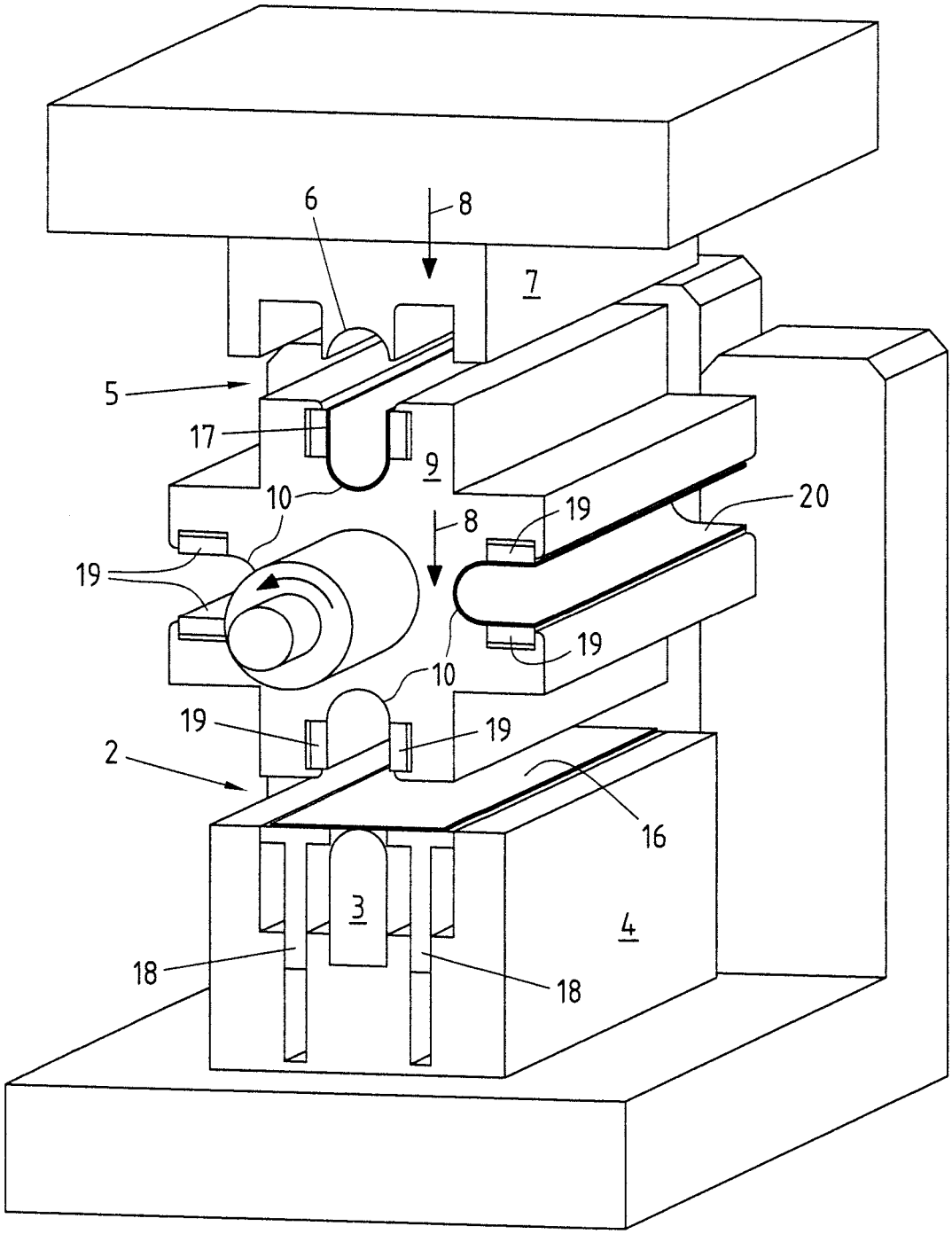
FIG. 2 is a schematic, perspective view of the embodiment of FIG. 1, with open tool halves.

FIG. 2 now shows the exemplarily embodiment of FIG. 1 likewise in a perspective schematic representation with an inserted sheet 16 as well as an at least partially U-shaped formed sheet 17. The sheet 16 lies on the hold-down devices 18 extending up to the apex baseline of the die 3, and can therefore be placed and positioned in a simple manner in the device. In addition, the movement directions 8 of the second tool half 7 and of the matrix receiver 9 in the closing procedure are also shown in FIG. 2. For the forming, the tool half 7 as well as the matrix receiver 9 move in the direction of the first tool half 4. Furthermore, it can be seen that the sidewalls of the U-shaped die 10 have a height that amounts to at least half the maximum rolled-out sidewall length of the hollow profile to be produced, i.e. the length of the arms of the U-shaped formed sheet. In addition, displaceable partial regions 19 are provided in the sidewalls, which serve for the improved threading of the arms of the at least partially U-shaped sheet during the O-forming in the second tool half 7.

Figure 3:
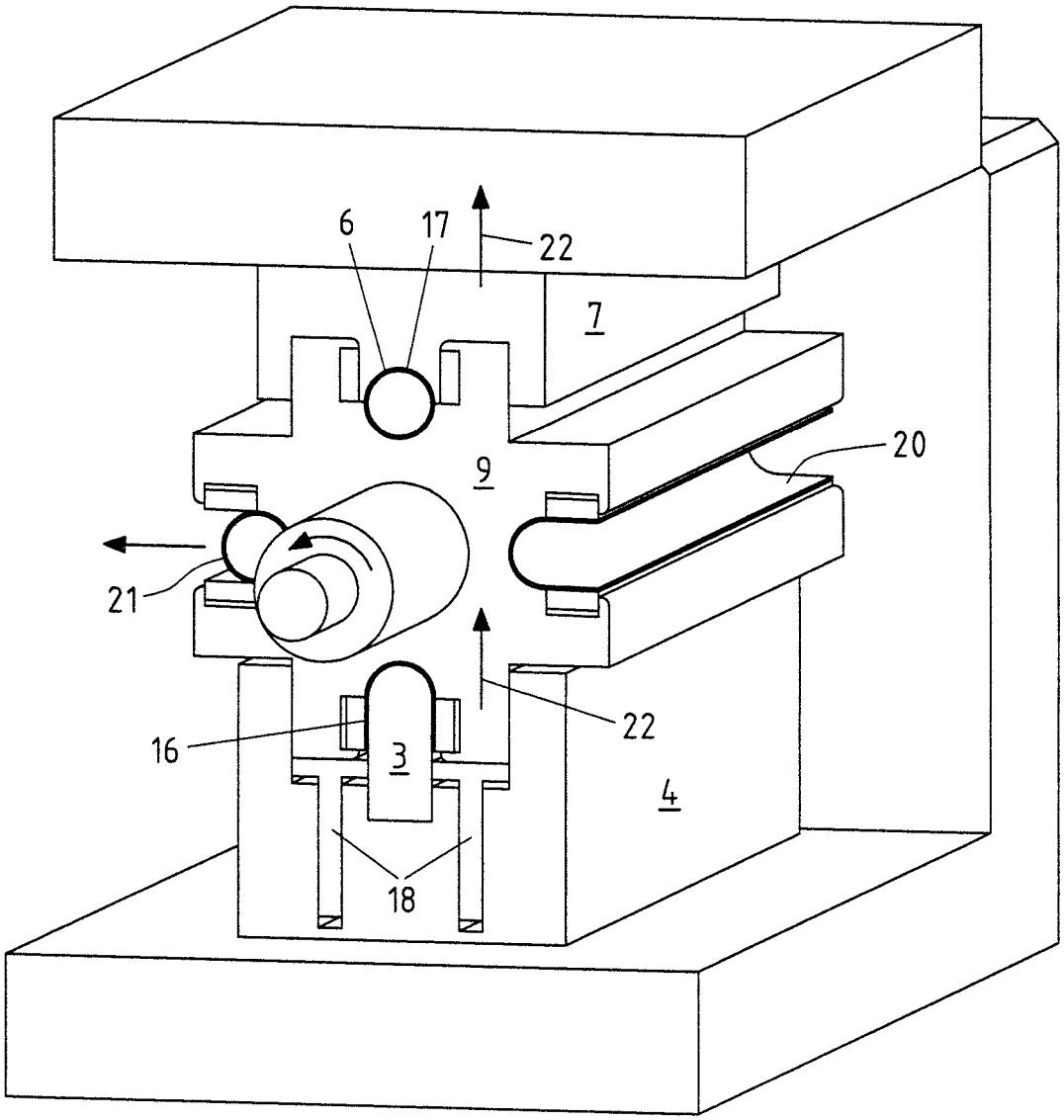
FIG. 3 is a schematic, perspective view of the embodiment of FIG. 2, with the closed tool halves.

FIG. 3 now shows the device 1 in the closed state, i.e. with the tool set 2, 5 closed. It can be seen that the sheet 1 has now been formed into an at least partially U-shaped sheet. FIG. 3 additionally shows in the U-shaped dies 10 of the matrix receiver 9 which are not involved in the forming, an at least partially U-shaped formed sheet 20 and a finally formed, at least partially closed hollow profile 21, resulting from the U-forming and from the O-forming, respectively, in the first tool half 4 and in the second tool half 7 after rotation of the matrix receiver 9 by 90° in the anticlockwise direction.

After the forming procedure the matrix receiver 9 is moved upwardly in the closing direction jointly with the second tool half 7, but only to the extent that the matrix receiver 9 is freely rotatable. The movement directions 22 of the tool half 7 as well as of the matrix receiver 9 are shown in this connection in FIG. 3. The finally shaped, at least partially closed hollow profile 21 can be removed in a simple manner, for example by using a corresponding robot, from the U-die 10 after the O-forming and a rotation of the matrix receiver 9 by 90° in the anticlockwise direction. Due to the simple design and construction of the device according to the invention it is therefore possible to carry out simultaneously with one closing movement two forming processes, namely a U-forming and an O-forming, and in addition, to ensure a simple removal of the finished products from the device.

It is furthermore conceivable that further processing steps, for example a welding step, can be carried out in an integrated manner in the same device by a larger number of at least partially U-shaped dies 10 in the matrix receiver 9, for example six or eight dies. Preferably, these work stages are performed in the matrix receivers 9 that are not involved in the forming.

Figure 4:
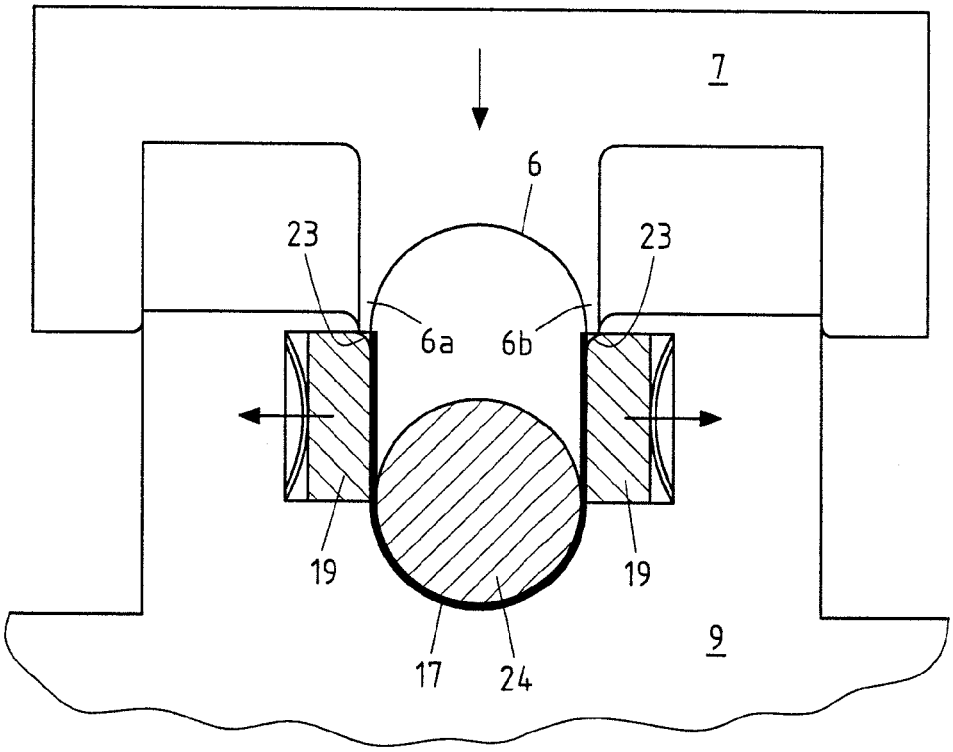
FIG. 4 is a schematic plan view of the second tool half of the embodiment of FIG. 1 before the threading of the U-arms of an at least partially U-shaped sheet.
Figure 5:
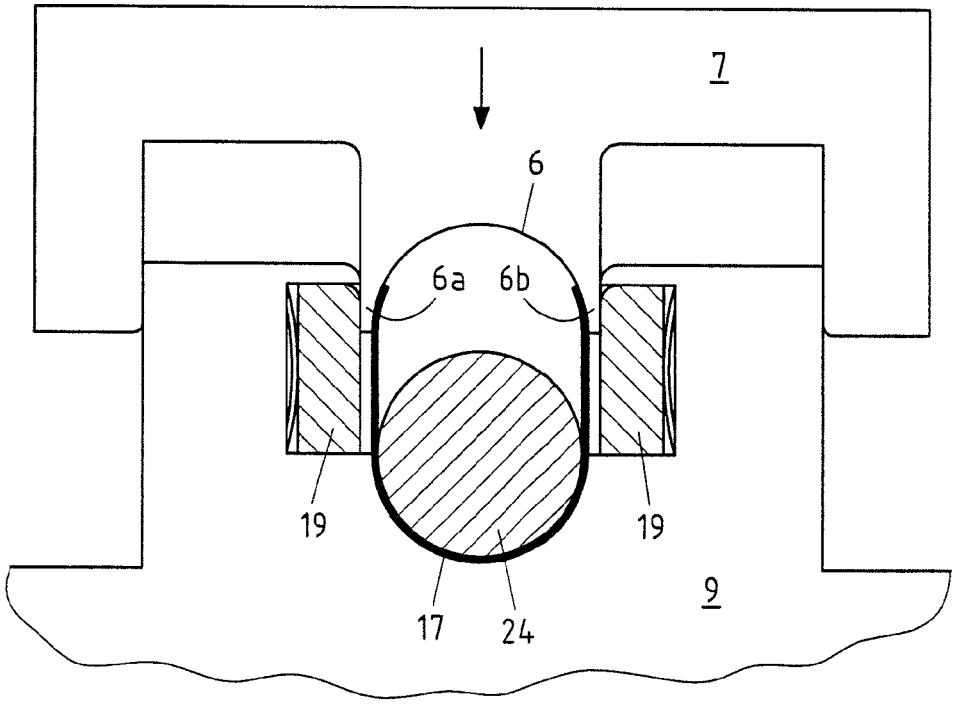
FIG. 5 is a schematic plan view of the second tool half during the threading of the arms of the at least partially U-shaped sheet during the closing procedure.

FIGS. 4 and 5 show in a schematic plan view the threading process in the second tool half 7 during the O-forming. The second tool half 7 comprises an upper die 6, whose sidewalls 6*a* and 6*b* press against the rounded inlets 23 of the displaceable partial regions 19 of the sidewalls of the at least partially U-shaped dies 10 of the matrix receiver 9 during the closing procedure. The displaceable partial regions 19 of the sidewalls are forced outwardly, for example against a spring loading, over the rounded inlets 23, so that the arms of the still U-shaped sheet 17 thread into the upper die 6 of the second tool half 7, FIG. 5. It is also conceivable that the partial regions 19 of the sidewalls are actively retracted during the immersion of the sidewalls 6*a*, 6*b* of the upper die 6, or that the "displacement" of the displaceable partial regions 19 of the sidewalls is assisted.

As a departure from the previously illustrated embodiments, an additional support core 24 is illustrated in FIGS. 4 and 5, which serves for the improved configuration of the final shape of the at least partially closed hollow profile. This support core had been introduced through a core puller system, not illustrated in FIGS. 4 and 5, into the at least partially U-shaped sheet, and is removed before the rotation of the matrix receiver 9.

The invention claimed is:

1. Device for producing at least partially closed hollow profiles from a sheet by a U-O-forming with a tool set, comprising:

a U-punch in a first tool half for producing an at least partially U-shaped sheet;

an upper die in a second tool half for forming an at least partially U-shaped sheet into an at least partially closed hollow profile;

wherein parts of the tool set run parallel to one another in the axial direction of the at least partially closed hollow profile to be produced and are arranged above one another in a closing direction of the first and second tool halves; and wherein a common matrix receiver is provided between the first and second tool halves of the tool set, comprising at least two identical, partially U-shaped dies for the tool set, and the matrix receiver can rotate about its axial axis.

2. Device according to claim 1, wherein the matrix receiver comprises more than two at least partially U-shaped dies, and wherein the number of dies is a multiple of two.

3. Device according to claim 1, wherein the matrix receiver can move in the closing direction of the tool halves and its weight is optionally relieved.

4. Device according to claim 1, wherein pillow blocks for a rotatable bearing of the matrix receiver and at least one core puller system are provided and the at least one core puller system is arranged on the pillow blocks.

5. Device according to claim 1, wherein the U-punch is arranged below the upper die, and hold-down devices are optionally associated with a U-punch.

6. Device according to claim 1, wherein the at least partially U-shaped dies of the matrix receiver comprise sidewalls whose height is at least half of a maximum, rolled-out sidewall length of the hollow profile to be produced.

7. Device according to claim 6, wherein sidewalls of the at least partially U-shaped dies have partial regions with a rounded inlet, which are outwardly displaceable.

8. Device according to claim 1, wherein means are provided for carrying out further work stages on the at least partially U-shaped sheet or on the at least partially closed hollow profile.

9. Method for producing an at least partially closed hollow profile using a device according to claim 1, comprising the following steps:

inserting a flat sheet into the first tool half;

forming the sheet in the first tool half to form an at least partially U-shaped sheet by closing the tool halves of the tool set;

opening the first and second tool halves and rotating the matrix receiver so that an at least partially U-shaped die with an at least partially U-shaped sheet is positioned in the second tool half and a further U-shaped die is positioned in the first tool half;

inserting a second sheet into the first tool half; and closing the first and second tool halves and simultaneously forming the partially U-shaped sheet into an at least partially closed hollow profile in the second tool half and forming the inserted sheet into a partially U-shaped sheet in the first tool half.

10. Method according to claim 9, wherein the matrix receiver comprises four at least partially U-shaped dies and the matrix receiver is rotated by 90° after the opening of the first and second tool halves.

11. Method according to claim 9, wherein the sidewalls of the at least partially U-shaped dies of the matrix receiver comprise outwardly displaceable partial regions with a rounded inlet, which on closure of the first and second tool halves of the tool set are displaced outwardly through the sidewalls of the upper die of the second tool half.

12. Method according to claim 9, wherein further work stages are carried out on the at least partially U-shaped sheet in the matrix receivers.

* * * * *